United States Patent [19]

Wätterbäck

[11] 4,153,846

[45] May 8, 1979

[54] DETECTOR FOR LIQUID MEDIA

[75] Inventor: Paul G. Wätterbäck, Stockholm, Sweden

[73] Assignee: AB Sibe International, Solna, Sweden

[21] Appl. No.: 818,667

[22] Filed: Jul. 25, 1977

[30] Foreign Application Priority Data

Mar. 23, 1977 [SE] Sweden ..... 7703328

[51] Int. Cl.[2] ..... H01H 35/18

[52] U.S. Cl. ..... 307/118; 200/61.04; 429/116

[58] Field of Search ..... 429/116, 119; 307/118; 200/193, 61.05, 61.06, 61.07, 61.08, 61.04; 340/235, 602, 604, 605

[56] References Cited

U.S. PATENT DOCUMENTS

| | | | |
|---|---|---|---|
| 2,432,367 | 12/1947 | Andresen | 200/61.04 |
| 2,594,879 | 4/1952 | Davis | 429/119 |
| 2,760,023 | 8/1956 | Kettering et al. | 200/61.06 |

*Primary Examiner*—Gene Z. Rubinson
*Assistant Examiner*—Morris Ginsburg
*Attorney, Agent, or Firm*—Cushman, Darby & Cushman

[57] ABSTRACT

A detector for liquid media has a swelling body which in the presence of the liquid expands to break open an ampule of electrolyte solution under pressure, enclosed in a rubber sheath together with a dry-charged galvanic element. The electrolyte enters the galvanic element, which starts producing electric current, thereby signalling presence of liquid.

4 Claims, 2 Drawing Figures

DETECTOR FOR LIQUID MEDIA

The present invention relates to a detector for detecting a liquid medium, especially water or oil, with a sensing device which reacts to the presence of the medium and, under the influence of the same, activates a device for producing electric current.

An example of the use of such a detector can be found in Swedish patent specification No. 346 369, according to which the detector is intended to operate a safety valve for shutting off the water supply to a household machine if water flows out from said machine. The valve is activated by means of the detector supplying a glow plug with electric current, the glow plug in turn influencing an explosive charge for closing the valve.

The invention is based on developing a detector of the kind disclosed above, and which functions reliably and does not have to be connected to any external source of electric energy. The detector according to the present invention shall also have as small dimensions as possible.

This is solved according to the invention by means of the sensing device being a swelling body which, upon the appearance of the liquid medium, swells and exerts pressure on the current-producing device so as to activate the same.

The invention is described in more detail below in the form of an example with reference being made to the accompanying drawing in which.

Figure 1:
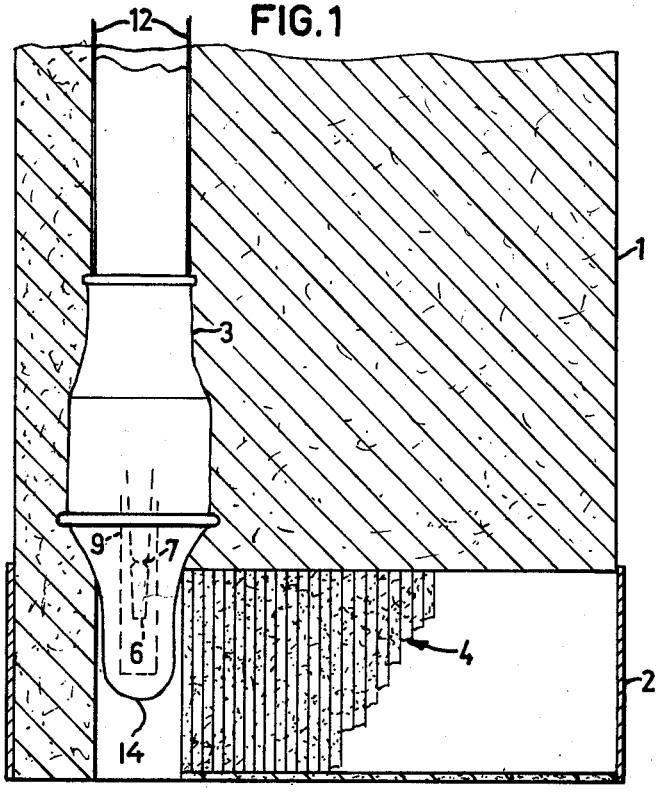
FIG. 1 is a schematic view of the planning of the detector.

FIG. 1 shows a block 1 of, for example, cellular plastic which, at the bottom in the figure, is surrounded by a reinforcement band 2 of, for example, steel, a unit 3 for release and production of electric current and a swelling body 4 being inserted in corresponding cavities in the block 1. The unit 3 and the body 4 form the active components of the detector. The swelling body 4 consists of a stack of comparatively thin sheets of cellulose or other water or oil-sensitive material, which swells when water or oil penetrates or comes into contact with the same. Naturally, it is also possible to use other material for the swelling body, material which also swells under the influence of other liquids.

Figure 2:
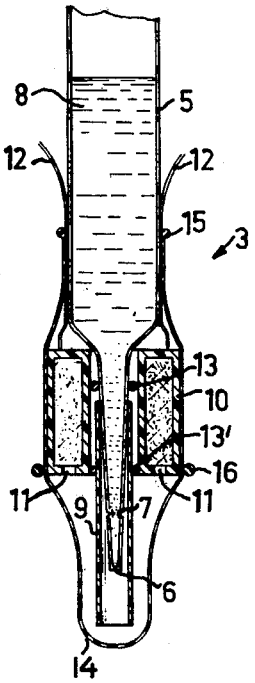
FIG. 2 is an enlarged scale longitudinal section through the essential portion of a unit included in the detector for production and supply of electric current.

FIG. 2 is an enlarged scale of the essential portion of the unit 3. This unit consists of an ampule 5 of, for example, glass, the downwardly-directed neck of which terminates in a hermetically sealed break-off tip 6 having a fractural impression 7. The ampule 5 is partially filled with a liquid 8 which is under pressure and, in the present case, consists of a 25% solution of sodium chloride. A resilient protective tube 9 of, for example, plastic or rubber extends from a point on the neck of the ampule past the break-off tip 6 so that said tip is protected from unintentional contact.

A dry-charged galvanic element 10, that is, an electric element which can be stored without electrolyte just about as long as desired but which is activated and produces current when filled with an electrolyte, in the present case the sodium chloride solution 8, is designed as a hollow ring and drawn onto the ampule neck in the shown manner. As such an element is known per se and available on the market, said element 10 is merely shown schematically with a cavity or electrolyte chamber in which the electrode system (not shown here) is arranged. Electric connecting wires 12 intended to be connected to applicable electrical regulating means lead out from the electrode system. The cavity is intended to be supplied with electrolyte liquid through openings 11 in the end wall of the ring. The unit 3 has small dimensions and the element 10 has, for example in the present case, a diameter of only approximately 16 mm, but can despite this provide a current of 400 mA at a voltage of 1.5 volts.

A sealing sheath 14 having a collar 15 is drawn over a portion of the length of the ampule 5 over the protective tube 9 and the element 10 for the purpose of tightly surrounding said portion so that a working space is formed inside the sheath 14, inside which the liquid 8, when the tip 6 is broken off as a result of the swelling body 4 exerting pressure on the same, flows from the ampule and through the holes 11 into the electrolyte chamber of the element 10, in which chamber the electrode system is situated. The sealing sheath 14 is comparatively thin-walled and deformable and can consist of plastic or rubber in order not to prevent the movement of the swelling body 4 towards the break-off tip 6. An O-ring 16 is mounted onto the outside of the sheath 14 on the same level as the end wall, provided with holes, of the element in order to tightly clamp the sheath against the outside of the element 10 and thereby also reduce the volume of the working space. An upper O-ring 13 between the ampule neck and the inside of the element ring prevents moisture from penetrating from the rear, so to speak, and holds the element on the neck, while a lower O-ring 13' between the protective tube 9 and the same inside of the element ring contributes to further reducing the volume of the working space. In order to eliminate all risk for possible remaining moisture after the sheath 14 has been mounted, a drying agent can be inserted in said sheath.

What I claim is:

1. A detector for detecting the presence of a liquid medium comprising: an ampule containing an electrolyte liquid; a galvanic element having an elelctrolyte chamber which in its inactive state lacks electrolyte, said galvanic element being capable of producing an electric current when electrolyte is supplied to said electrolyte chamber; and sensing means for activating said galvanic element in response to the presence of the liquid to be detected, said means including a swelling body which swells upon contact with the liquid to be sensed, the swelling of said body effecting transfer of electrolyte from said ampule to said electrolyte chamber.

2. A detector as in claim 1 wherein said ampule has an end facing the swelling body and provided with a break-off tip, at least said tip and said galvanic element being contained in a tightly-sealed, deformable casing, whereby swelling of the body, upon contact with the liquid medium breaks the break-off tip by means of pressure against the same, the electrolyte liquid in the ampule thereby flowing out from said ampule and into said electrolyte chamber.

3. A detector as in claim 1 wherein said swelling body includes an elongated stack of cellulose sheets.

4. A detector as in claim 1 wherein the liquid in the ampule is a sodium chloride solution.

* * * * *